United States Patent [19]

Stepe

[11] 4,027,409

[45] June 7, 1977

[54] GROUND ENGAGING ELEMENT HAVING A CONTROLLED CUTTING EDGE

[75] Inventor: Visvaldis A. Stepe, Willow Springs, Ill.

[73] Assignee: Caterpillar Tractor Co., Peoria, Ill.

[22] Filed: July 2, 1976

[21] Appl. No.: 702,170

[52] U.S. Cl. ..... 37/142 R; 172/713

[51] Int. Cl.[2] ..... E02F 9/28

[58] Field of Search ..... 37/142 R, 142 A, 141 T, 37/141 R; 172/713, 699, 700

[56] References Cited

UNITED STATES PATENTS

| | | | |
|---|---|---|---|
| 1,395,048 | 10/1921 | McKee | 37/142 R |
| 1,860,338 | 5/1932 | Taylor, Jr. | 37/142 R |
| 3,149,679 | 9/1964 | Johnson et al. | 172/713 |
| 3,300,883 | 1/1967 | Troeppl, et al. | 37/142 R |
| 3,312,002 | 4/1967 | Benetti | 37/142 R |
| 3,755,933 | 9/1973 | Lowrey | 37/142 R |
| 3,888,028 | 6/1975 | White | 37/142 R |

*Primary Examiner*—Clifford D. Crowder
*Attorney, Agent, or Firm*—Frank L. Hart

[57] ABSTRACT

A ground engaging element having slots extending therethrough and being positioned at preselected locations, being of preselected configuration, and terminating at preselected distances from a forward cutting edge of the element for controllably breaking away selected portions of the element in response to forces subjected on the element after the forward edge has been worn away a preselected amount.

11 Claims, 6 Drawing Figures

GROUND ENGAGING ELEMENT HAVING A CONTROLLED CUTTING EDGE

BACKGROUND OF THE INVENTION

In the use of ground engaging tools, particularly vehicle operated tools, for example loaders or excavators, the forward edge sometimes becomes blunted during wear which decreases the penetrating properties and increases the horsepower required. This results in an undesirable waste of fuel, labor and time.

Ground engaging elements have been constructed which wear to a preselected sharpened configuration or break away portions of the element to sharpen the element. Examples of these heretofore utilized ground engaging elements are as follows: U.S. Pat. No. 3,888,028 — white; U.S. Pat. No. 3,755,933 — Lowrey; U.S. Pat. No. 3,312,002 — Benetti; U.S. Pat. No. 3,300,883 — Troeppl et al; and U.S. Pat. No. 3,149,679 — Johnson et al.

These apparatus provide a limited amount of control over when the cutting edge was sharpened during the use thereof. It was decided, however, that waste could further be decreased by constructing a ground engaging element which had improved control over the cutting edge and which cutting edge would be transformed at a more predictable time during the wearing away of the cutting edge in response to operation of the element.

This invention therefore resides in a ground engaging element having slots extending therethrough and being of a construction and at a location sufficient for controlled breakaway of selected portions of the element in response to forces subjected on the element after the forward edge has been worn away a preselected amount.

DETAILED DESCRIPTION OF THE INVENTION

Figure 1:
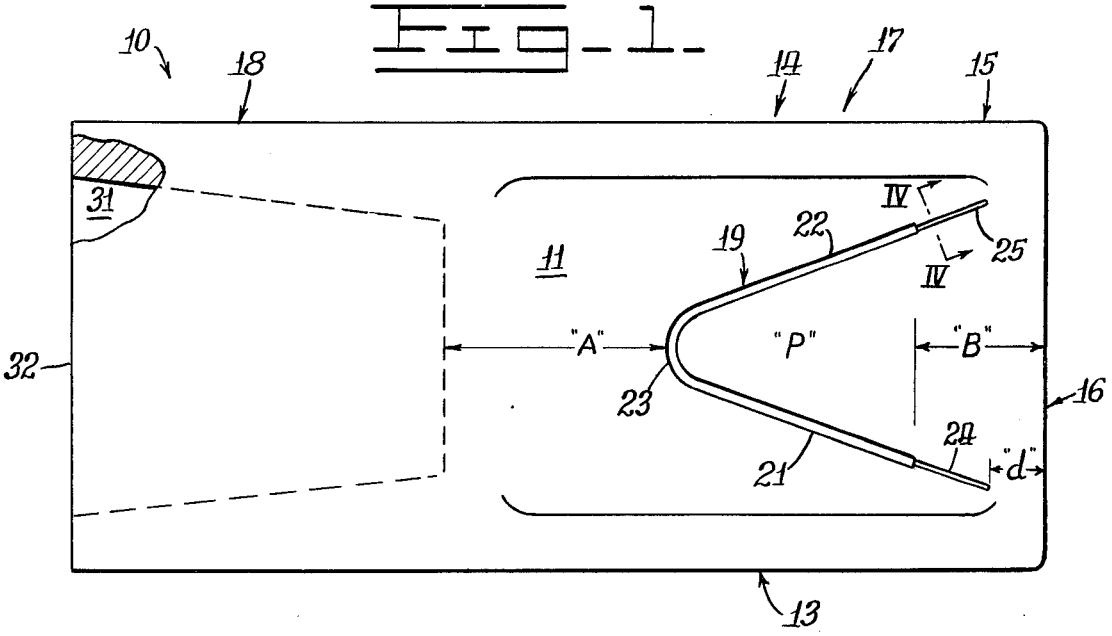
FIG. 1 is a diagrammatic plane view of an element of this invention.
Figure 2:
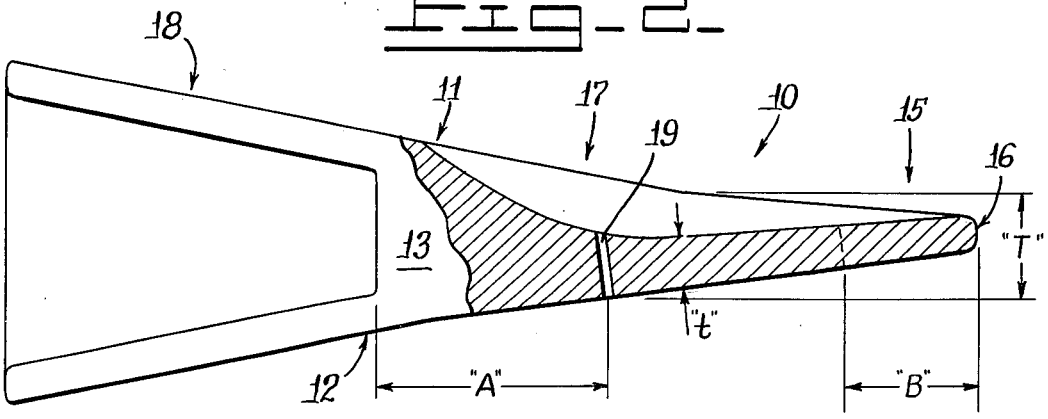
FIG. 2 is a diagrammatic side view of the element of FIG. 1.

Referring to FIGS. 1 and 2, the ground engaging element 10 of this invention has first and second opposed surfaces 11, 12, first and second edges 13, 14, a forward end portion 15, a forward edge 16, a middle portion 17, and a rearward end portion 18. The rearward end portion 18 is connectable to a shank of a vehicle, for example, and the forward end portion 15 is the cutting edge of the element 10.

The first and second surfaces 11, 12 impinge or converge from the rearward portion 18 toward the forward portion 15 to form the relatively sharp cutting edge 16 for penetrating the earth. The first and second edges 13, 14 are therefore of a general triangular or wedge configuration.

The middle portion 17 of the element 10 has at least one slot 19 of preselected configuration and location which extends through the element 10 from the first to the second surfaces 11, 12. The slot 19 or slots extend along the middle portion 17 of the element 10 from a first preselected location spaced a preselected distance "A" from the rearward end portion 18 to a second preselected location spaced a preselected distance "B" from the forward edge 16.

The second location at which the forward end of the slot 19 or slots terminate is sufficient for breaking away a preselected portion "P" or portions of the element 10 in response to forces subjected on the element 10 after the forward end portion 15 has been worn away a preselected amount.

In the embodiment of FIGS. 1 and 2, the slot 19 is of a general "U" configuration having leg portions 21, 22 spaced from the first and second edge portions 13, 14. The curvilinear portion 23 of the slot 19 is spaced the preselected distance "A" from the rearward end portion 18 of the element 10 and the leg portions 21, 22 terminate the preselected distance "B" from the forward edge 16. The distance "B" is provided for controllably breaking away the portion "P" after the forward edge 16 has worn away a preselected amount. The distance "A" is provided for assuring that the element 10 is of sufficient strength to withstand the expected impacts and forces without breaking the element 10 between the slot 19 and the rearward end portion 18.

Figure 3:
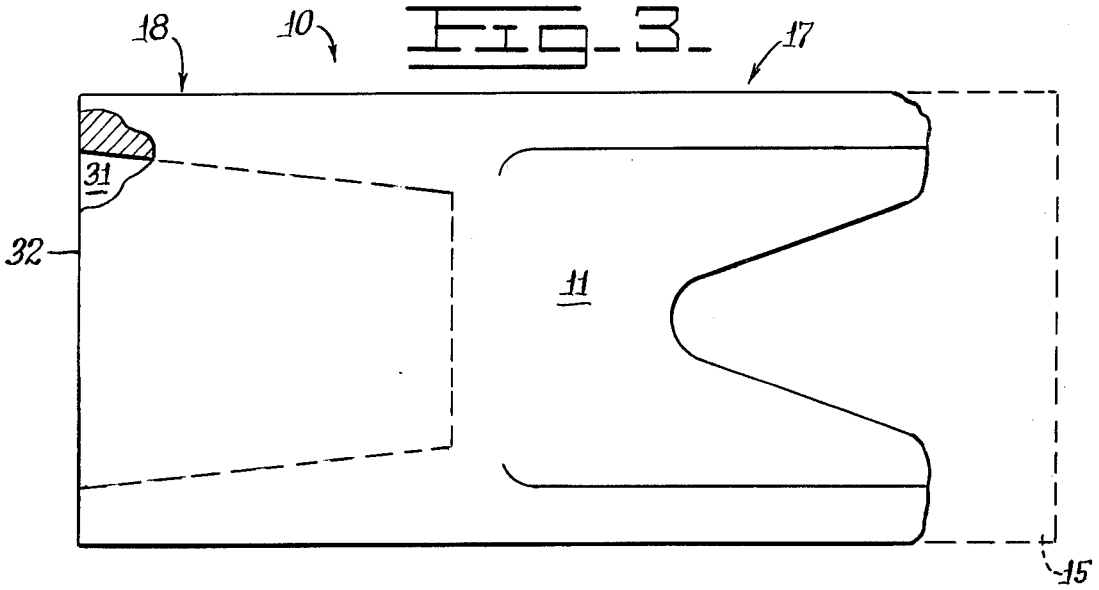
FIG. 3 is a diagrammatic side view of a worn element of FIG. 1.

The central or breakaway portion "P" of the element 10 preferably has a cross sectional thickness "*t*" less than the adjacent thickness "T" of the first and second edge portions 13, 14. By this construction, material of the breakaway portion "P" is reduced and the resultant worn, breakaway configuration of the element, as shown in FIG. 3, is of rugged construction for heavy-duty penetration.

Figure 4:
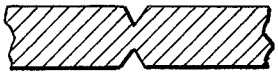
FIG. 4 is a diagrammatic sectional view of the element of FIG. 1 taken along lines IV-IV.

In order to further control the breaking away of portion "P", a notch 24, 25 extends along one or both of the surfaces 11, 12 from ends of respective leg portions 21, 22 of the slot 19 a preselected distance toward the forward edge 16 of the element 10, as shown in FIGS. 1 and 4. The notches 24, 25 each preferably terminate substantially common distances "*d*" from the forward edge 16.

Figure 5:
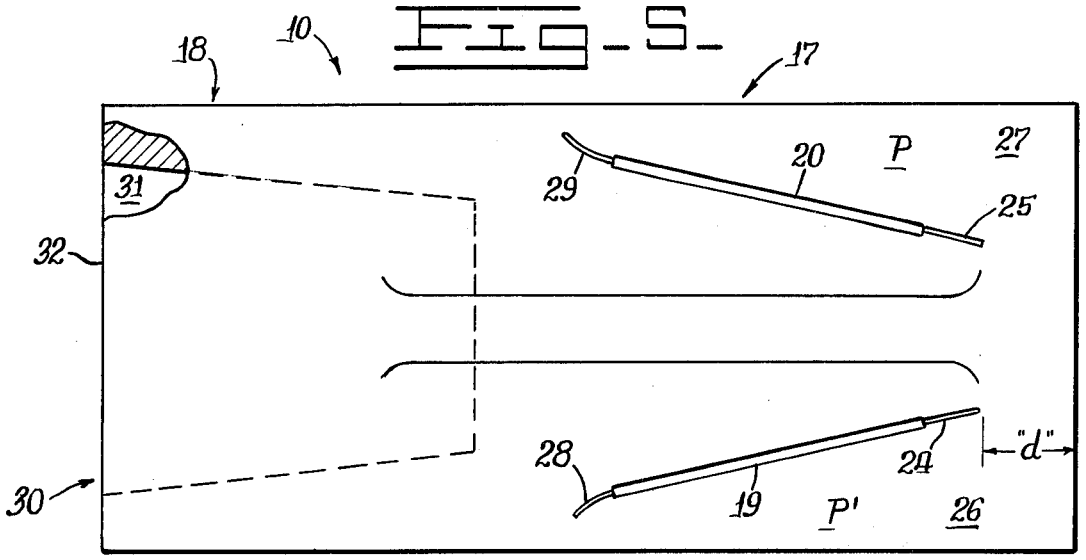
FIG. 5 is a diagrammatic plane view of another embodiment of the element of this invention.

Referring to FIG. 5, the element 10 has first and second spaced apart slots 19, 20 each of a generally linear configuration which impinge toward one another in a direction from the middle portion 17 of the element toward the forward edge 16. In this construction, first and second edge portions 26, 27 break away from the element 10 to provide a single tooth resultant configuration.

Figure 6:
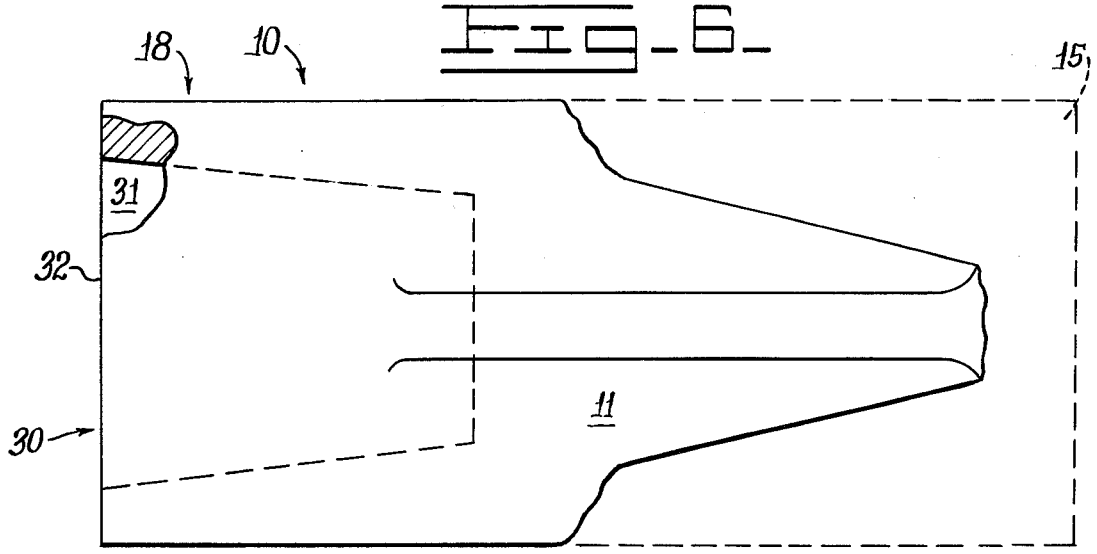
FIG. 6 is a diagrammatic plane view of a worn element of FIG. 5.

Preferably notches 24, 25 each extend from the forward end of a respective slot 19, 20 a preselected distance toward the forward edge 16 of the element 10. The notches 24, 25 preferably terminate substantially common distances "*d*" from the forward edge 16. Notches 28, 29 can also be associated with the rearward ends of respective slots 19, 20 for providing additional controlled breakaway of the edge portions 26, 27. FIG. 6 shows the resultant worn, broken away configuration of the embodiment of FIG. 5.

The rearward end portion 18 of the element 10 has means 30 for connecting said rearward end portion 18 to a shank of a vehicle (not shown). The means 30 preferably comprises a chamber 31 opening on a rearward end 32 of the element 10.

In the construction of the apparatus of this invention, the thickness of the element portions and positioning of the slots and notches are dependent upon the expected use of the ground engaging element 10. Once the use is determined, the expected forces subjected on the element 10 is known by one skilled in the art. The preselected distances and thicknesses set forth above can then be readily determined for controllably breaking away the selected portions "P" and "P'" of the element in response to wear and forces subjected thereupon. The breakaway forces can result from normal digging operations or, at the operator's option, he can purposefully knock out or wedge out the portions after the cutting edge has been worn a desirable amount and/or horsepower requirements for operation have increased above a desired magnitude. The notches provide a more uniform cutting edge after break out of the portions. The notches can also be constructed to provide increased control over the wear that the tool will experience before the portions are broken away during digging operation. One skilled in the art can readily determine these parameters to provide the desired control over alteration of the element.

Example dimensions of the element of this invention are as follows:

Metal; Cast Steel
Length Tip; 33.0 cm.
Width; 14.0 cm.
Thicknesses
Rearward End (32); 2.0 cm.
Middle Portion "T"; 5.0 cm.
Middle Portion "*t*"; 3.0 cm.
Forward Edge (16); 1.0 cm.
Slot configuration; "U" Shaped
Overall Length; 6.0 cm.
Angle of Legs from Centerline; 30°
Distances
"A"; 10.0 cm.
"B"; 5.0 cm.
"D"; 3.0 cm.
Notches
width; 0.5 cm.
Depth; 0.5 cm.

Other aspects, objects, and advantages of this invention can be obtained from a study of the drawings, the disclosure, and the appended claims.

What is claimed is:

1. A ground engaging element having first and second opposed surfaces, first and second edges, a forward end portion, a middle portion and a rearward end portion, said first and second surfaces converging from the rearward toward the forward portion to form a relatively sharp forward edge for penetrating the earth, said middle portion having at least one slot extending through the element from the first to the second surfaces and extending along the middle portion, said slot being of general "U" configuration having leg portions of the slot spaced from the first and second edge portions and extending outwardly from a curvilinear middle portion of the slot, said curvilinear portion being positioned a preselected distance from the rearward end portion and said leg portions terminating a preselected distance from the forward edge for controlled breakaway of a central portion of the element in response to forces subjected on the element after the forward end portion has been worn away a preselected amount.

2. A ground engaging element, as set forth in claim 1, wherein the central portion has a cross sectional thickness less than the adjacent cross sectional thickness of the first and second edge portions.

3. A ground engaging element, as set forth in claim 1, including a notch extending along one of the first or second surfaces from each leg end of the slot a preselected distance toward the forward edge.

4. A ground engaging element, as set forth in claim 3, wherein the notches each terminate substantially common distances from the forward edge.

5. A ground engaging element, as set forth in claim 1, including means for connecting the rearward end portion to a shank.

6. A ground engaging element, as set forth in claim 5, wherein the means comprises a chamber opening on a rearward end of the element.

7. A ground engaging element having first and second opposed surfaces, first and second edges, a forward end portion, a middle portion, and a rearward end portion, said first and second surfaces converging from the rearward toward the forward portion to form a relatively sharp forward edge for penetrating the earth, said middle portion having at least first and second slots extending through the element from the first to the second surfaces and convergingly extending along the middle portion toward one another in a direction from a first location spaced a preselected distance from the rearward portion to a second location spaced a preselected distance from the forward edge, said second location being sufficient for breaking away of first and second edge portions of the element in response to forces subjected on the element after the forward end portion has been worn away a preselected amount.

8. A ground engaging element, as set forth in claim 7, including means for connecting the rearward end portion to a shank.

9. A ground engaging element, as set forth in claim 8, wherein the means comprises a chamber opening on a rearward end of the element.

10. A ground engaging element, as set forth in claim 7, including a notch extending from the forward end of each slot a preselected distance toward the forward edge of the element.

11. A ground engaging element, as set forth in claim 10, wherein the notches each terminate substantially common distances from the forward edge of the element.

* * * * *